US010105616B2

(12) United States Patent
Amireh

(10) Patent No.: US 10,105,616 B2
(45) Date of Patent: Oct. 23, 2018

(54) IR DONGLE WITH SPEAKER FOR ELECTRONIC DEVICE

(71) Applicant: Mattel, Inc., El Segundo, CA (US)

(72) Inventor: Nicholas Amireh, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 924 days.

(21) Appl. No.: 13/903,568

(22) Filed: May 28, 2013

(65) Prior Publication Data

US 2013/0331002 A1 Dec. 12, 2013

Related U.S. Application Data

(60) Provisional application No. 61/651,873, filed on May 25, 2012.

(51) Int. Cl.
*A63H 30/04* (2006.01)

(52) U.S. Cl.
CPC ..... *A63H 30/04* (2013.01)

(58) Field of Classification Search
CPC ..... A63H 30/00
USPC ..... 446/454
See application file for complete search history.

(56) References Cited

U.S. PATENT DOCUMENTS 2,991,587 A * 7/1961 Blanchard ..... 446/154
3,706,153 A * 12/1972 Folson et al. ..... 446/451
4,807,031 A 2/1989 Broughton et al.
4,930,019 A 5/1990 Chu
4,981,456 A * 1/1991 Sato et al. ..... 446/36
5,158,495 A * 10/1992 Yonezawa ..... 446/456
5,636,994 A 6/1997 Tong
5,671,267 A 9/1997 August et al.
5,752,880 A 5/1998 Gabai et al.
5,901,366 A 5/1999 Nakano et al.
6,022,273 A 2/2000 Gabai et al.
6,075,195 A 6/2000 Gabai et al.
6,206,745 B1 3/2001 Gabai et al.
6,290,566 B1 9/2001 Gabai et al.
6,352,478 B1 3/2002 Gabai et al.
6,368,177 B1 4/2002 Gabai et al.
6,439,956 B1 8/2002 Ho
6,487,422 B1 11/2002 Lee
6,739,659 B2 * 5/2004 Dukes ..... 297/256.13
6,773,322 B2 8/2004 Gabai et al.
6,857,034 B1 * 2/2005 DiSanza et al. ..... 710/106
6,931,231 B1 * 8/2005 Griffin ..... 455/3.06
(Continued)

FOREIGN PATENT DOCUMENTS

JP 2005000504 A 1/2005

*Primary Examiner* — John E Simms, Jr.
*Assistant Examiner* — Dolores Collins
(74) *Attorney, Agent, or Firm* — Edell, Shapiro & Finnan, LLC

(57) ABSTRACT

The present invention relates to an electronic device, and in particular, to the input and output of data from the electronic device. An object is connected to the electronic device and configured to convert a portion of the audio signal output by the electronic device into an audible output. The object also converts a portion of the audio signal output by the electronic device into an infrared signal that is emitted to a toy vehicle. With the object connected to the electronic device, the electronic device is able to remotely control the toy vehicle while the object outputs sound effects and other audible sounds.

12 Claims, 13 Drawing Sheets

(56) References Cited

U.S. PATENT DOCUMENTS

| | | | | |
|---|---|---|---|---|
| 7,025,657 | B2 | 4/2006 | Nishimoto | |
| 7,044,826 | B2 * | 5/2006 | Edwards | 446/428 |
| 7,095,981 | B1 | 8/2006 | Voroba et al. | |
| 7,217,192 | B2 | 5/2007 | Nishiyama | |
| 7,288,917 | B2 * | 10/2007 | Art et al. | 320/107 |
| 7,427,225 | B2 * | 9/2008 | Matsukawa et al. | 446/256 |
| 7,460,991 | B2 | 12/2008 | Jones et al. | |
| 7,618,325 | B2 | 11/2009 | Yamada et al. | |
| 7,630,646 | B2 | 12/2009 | Anderson et al. | |
| 7,697,902 | B2 | 4/2010 | Johansson | |
| 7,789,728 | B2 * | 9/2010 | Friedman et al. | 446/429 |
| 7,796,978 | B2 | 9/2010 | Jones et al. | |
| 7,798,885 | B2 | 9/2010 | Wong et al. | |
| 7,803,032 | B2 * | 9/2010 | Yamaguchi et al. | 446/454 |
| 7,969,513 | B1 * | 6/2011 | Weber | 348/734 |
| 8,038,504 | B1 * | 10/2011 | Wong | 446/454 |
| 8,126,450 | B2 | 2/2012 | Howarter et al. | |
| 8,185,100 | B2 | 5/2012 | Jones et al. | |
| 8,216,036 | B2 | 7/2012 | Eyzaguirre et al. | |
| 8,260,283 | B2 | 9/2012 | Pope et al. | |
| 8,600,432 | B2 | 12/2013 | Krupnik | |
| 8,633,981 | B2 * | 1/2014 | Russoniello et al. | 348/114 |
| 8,712,245 | B1 * | 4/2014 | Alao et al. | 398/106 |
| 2002/0133818 | A1 | 9/2002 | Rottger | |
| 2002/0173219 | A1 | 11/2002 | Kilstrom | |
| 2005/0137018 | A1 * | 6/2005 | Dernis et al. | 463/43 |
| 2006/0105670 | A1 * | 5/2006 | Seymour | 446/456 |
| 2006/0128267 | A1 * | 6/2006 | Yamaguchi et al. | 446/454 |
| 2006/0128268 | A1 * | 6/2006 | Laurienzo et al. | 446/454 |
| 2006/0264149 | A1 * | 11/2006 | Byers et al. | 446/454 |
| 2006/0293102 | A1 | 12/2006 | Kelsey | |
| 2007/0035412 | A1 | 2/2007 | Dvorak et al. | |
| 2007/0063834 | A1 | 3/2007 | Bozzone et al. | |
| 2007/0096938 | A1 * | 5/2007 | Lopez et al. | 340/825.69 |
| 2007/0293124 | A1 | 12/2007 | Smith et al. | |
| 2008/0014833 | A1 * | 1/2008 | Bozzone et al. | 446/454 |
| 2008/0026671 | A1 | 1/2008 | Smith et al. | |
| 2009/0005167 | A1 | 1/2009 | Arrasvuori et al. | |
| 2009/0239587 | A1 | 9/2009 | Negron et al. | |
| 2009/0284553 | A1 | 11/2009 | Seydoux | |
| 2009/0295616 | A1 * | 12/2009 | Martin | 341/176 |
| 2010/0062817 | A1 | 3/2010 | Seydoux | |
| 2010/0203933 | A1 | 8/2010 | Eyzaguirre et al. | |
| 2011/0003640 | A9 | 1/2011 | Ehrman | |
| 2011/0021109 | A1 | 1/2011 | Le et al. | |
| 2011/0053457 | A1 * | 3/2011 | Rehkemper et al. | 446/454 |
| 2011/0086631 | A1 | 4/2011 | Park et al. | |
| 2011/0125601 | A1 | 5/2011 | Carpenter et al. | |
| 2011/0126005 | A1 | 5/2011 | Carpenter et al. | |
| 2011/0144778 | A1 | 6/2011 | Fung et al. | |
| 2011/0148604 | A1 * | 6/2011 | Miller | 340/12.22 |
| 2011/0223899 | A1 | 9/2011 | Hiraide | |
| 2011/0227871 | A1 | 9/2011 | Cannon | |
| 2011/0275274 | A1 | 11/2011 | Dewitt et al. | |
| 2011/0275410 | A1 | 11/2011 | Caffey et al. | |
| 2012/0035799 | A1 | 2/2012 | Ehrmann | |
| 2012/0050198 | A1 | 3/2012 | Cannon | |
| 2012/0149359 | A1 | 6/2012 | Huang | |
| 2012/0171927 | A1 | 7/2012 | Yu | |
| 2012/0231837 | A1 | 9/2012 | Hilbrink et al. | |
| 2013/0040530 | A1 | 2/2013 | Matsuno | |
| 2013/0157509 | A1 * | 6/2013 | Srivastava et al. | 439/625 |
| 2014/0062680 | A1 * | 3/2014 | Chen et al. | 340/12.32 |
| 2014/0186044 | A1 * | 7/2014 | Alao et al. | 398/106 |

* cited by examiner

IR DONGLE WITH SPEAKER FOR ELECTRONIC DEVICE

CROSS REFERENCE TO RELATED APPLICATION AND CLAIM TO PRIORITY

This application claims priority under 35 U.S.C. 119(e) to U.S. Provisional Patent Application Ser. No. 61/651,873, entitled "IR Dongle with Speaker for Electronic Device", filed May 25, 2012, the disclosures of which is incorporated herein by reference in its entirety for all purposes.

FIELD OF THE INVENTION

The present invention relates to an electronic device, and in particular, to the input and output of data from the electronic device. Specifically, the present invention relates to a module that connects to an electronic device that transforms the electronic device into a remote control for a toy vehicle. The module converts an audio signal into a signal, such as an infrared signal, and then broadcasts that signal.

BACKGROUND OF THE INVENTION

Various electronic devices including a touch screen configured to detect an object (e.g. a stylus) or a user's finger are known. Some electronic devices provide for a virtual environment presented on a display, on which physical objects may be placed on the display and optically detected using a camera. Other devices receive data transmitted from memory provided in an object. Other devices are used solely as a remote control and do not provide any other feature than to control a child's toy vehicle or figure remotely.

Children are becoming more familiar and comfortable with the use of electronic devices, such as mobile phones, tablets, etc. However, conventional children's toys lack the ability to be used with such electronic devices.

SUMMARY OF THE INVENTION

In one embodiment, an electronic device can be configured to receive information or data. In addition, the electronic device can be configured to output information or data. The output from the electronic device may include an encoded or embedded signal. A module can be used with the electronic device to decode the embedded or encoded signal from the electronic device and transmit it to a remote object, such as a toy. The embedded or encoded signal can be used to drive functionality in the remote object.

In one embodiment, a case can be coupled to the electronic device. The case can include a module having circuitry that can be in communication with the electronic device. The module may be in direct contact with the electronic device, such as a plug in a headphone jack of the electronic device. Alternatively, the module may be spaced apart from the electronic device.

The present invention is directed to a device that connects to an electronic device, enabling the electronic device to control a toy vehicle, including an input capable of being connected to an electronic device and configured to receive signals from the electronic device, a first channel containing an infrared emitter, a second channel containing a speaker configured to output audible sounds, and a control unit that processes the received signal into two individual signals, wherein one signal is sent to the infrared emitter and the other signal is sent to the speaker.

In another embodiment, the device further contains a microphone input with an infrared receiver for receiving infrared signals to be processed by the electronic device. Moreover, the device may contain an on/off switch and at least one LED. Furthermore, the device may contain a casing that houses the first channel, the second channel, and the control unit.

The present invention is also directed to a device that connects to an electronic device, enabling the electronic device to control a toy vehicle, including an input capable of connecting to an electronic device and configured to receive signals from the electronic device, a microphone input containing an infrared receiver for receiving infrared signals to be processed by the electronic device, a first channel containing an infrared emitter, a second channel containing a speaker configured to output audible sounds, and a control unit that processes the received signal into two individual signals, wherein one signal is sent to the infrared emitter and the other signal is sent to the speaker.

In another embodiment, the device may contain an on/off switch and at least one LED. Furthermore, the device may contain a casing that houses the first channel, the second channel, the control unit, and the microphone input.

Additionally, the present invention is directed to a control unit including an electronic device containing a headphone jack, an electronic toy vehicle containing an infrared signal receiver, and a module containing a headphone plug configured for connecting to the headphone jack of the electronic device and for receiving data signals from the electronic device, an infrared emitter configured for sending infrared signals to the electronic toy vehicle, a speaker configured to output audible sounds, and a control unit that processes the received data signal into two individual signals, wherein one signal is sent to the infrared emitter and the other signal is sent to the speaker.

In another embodiment, the device further contains a microphone input with an infrared receiver for receiving infrared signals to be processed by the electronic device. Moreover, the device may contain an on/off switch and at least one LED. Furthermore, the device may contain a casing that houses the first channel, the second channel, the control unit, and the microphone input. Additionally, the electronic device contains a touch screen and the electronic toy vehicle contains an infrared emitter.

BRIEF DESCRIPTION OF THE DRAWINGS

Like reference numerals have been used to identify like elements throughout this disclosure.

DETAILED DESCRIPTION OF THE INVENTION

Figure 1:
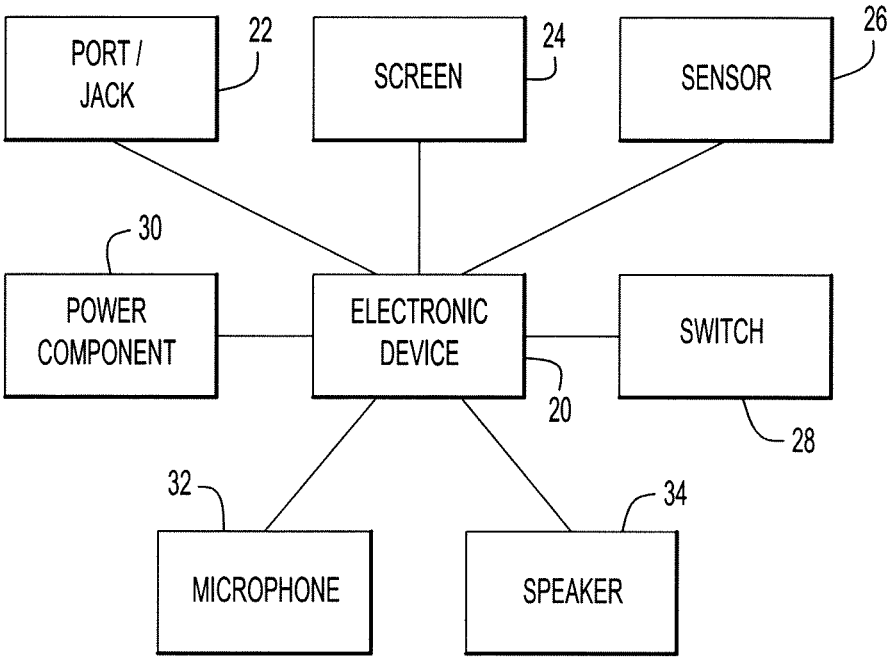
FIG. 1 illustrates a schematic block diagram of an electronic device according to an embodiment of the present invention.

Referring to FIG. 1, a schematic block diagram of an embodiment of an electronic device is illustrated. In this embodiment, the electronic device 20 includes several components. It is to be understood that in alternative embodiments, the electronic device 20 may not include all of the components illustrated in FIG. 1. Moreover, the electronic device 20 may include more than one of the particular components illustrated in FIG. 1.

In FIG. 1, the electronic device 20 is illustrated as having several components, including a port or jack 22, a visual display component 24, such as a screen, a sensor 26, a switch 28, a power component 30, a microphone 32, and a speaker 34. Each of these components can be used to input data or information to and/or output data or information from the device 20.

Regarding the inputting of data to the device 20, several of the components of device 20 can be used. Some such components include the port or jack 22, the screen 24, the sensor 26, the switch 28, and the microphone 32.

The electronic device 20 may include a housing with a port or jack 22 formed therein. The port or jack 22 can be a headphone jack or a microphone jack. The port or jack 22 is sized to receive a plug that is connected to one or more components. The plug that is inserted into the jack 22 is in electrical contact with the system of the device 20. The plug that is inserted into the jack 22 can include a contact that engages the microphone line in the headphone jack 22. In one embodiment, the port or jack 22 of the electronic device 20 includes a microphone line in communication therewith. Thus, the plug is directly coupled to the line in the jack 22. Data can be transmitted out via the microphone lead in the headphone jack.

Figure 2:
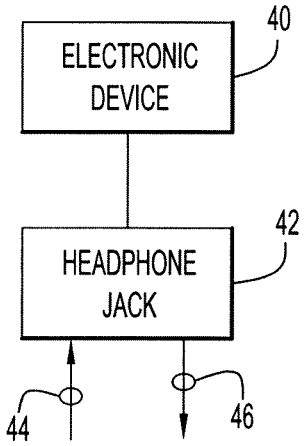
FIG. 2 illustrates a schematic block diagram of an electronic device according to an embodiment of the invention.

Referring to FIG. 2, in one embodiment, the electronic device 40 includes a headphone jack 42 and the jack 42 can be used to input data (arrow 44) to the electronic device 40 and output data (arrow 46) from the electronic device 40.

Figure 3:
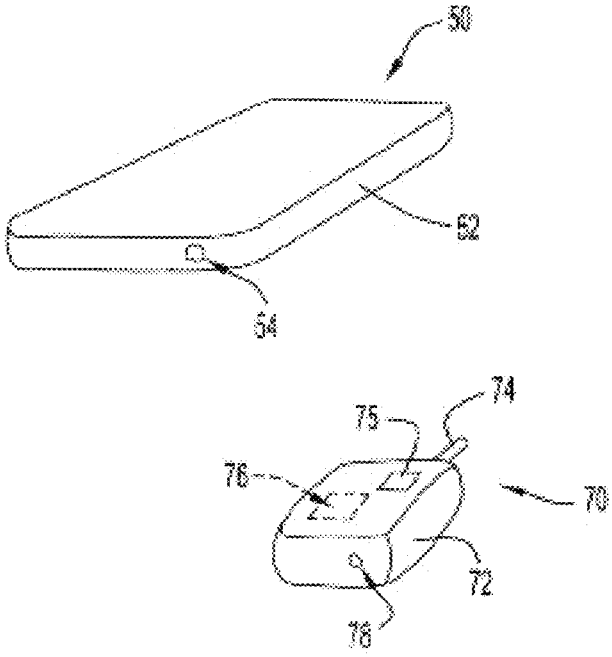
FIG. 3 illustrates a perspective view of an electronic device and an accessory for use with the electronic device according to different embodiments of the invention.

Referring to FIG. 3, an electronic device 50 includes a housing 52 with a port 54. In one embodiment, as shown in FIG. 3, the component or module 70 includes a housing 72 with a plug 74 that can be inserted into the port or jack 54 of the device 50. The discussion of the functions of module 70 applies to the other modules of other embodiments described in greater detail later.

The component 70 can be used to process, distribute, manipulate or otherwise handle a signal from the device 50 that is communicated via the plug 74 to component 70. The component 70 may include a transmitter 76 that can transmit signals externally from the housing 72 to a different object or device via one of several types of communications, including RF, IR, a light such as a bulb or an LED, wired, audio, video, Bluetooth, WiFi, ZigBee, or other wireless communication. The component 70 can be directly coupled to the jack and as a result, the component 70 can be powered by drawing power from the electronic device 50. In one implementation, the component 70 may include a AC/DC converter for this purpose.

The signal from the device 50 may be an audio signal and/or a video signal which includes an encoded or embedded signal therein. The module 70 includes audio decoding circuitry 75 that can decode the encoded or embedded signal to a known or usable signal, which can be processed and assigned a code and subsequently transmitted by the transmitter 76 to a receiver of a different device. The embedded or encoded signal can be used to drive functionality (such as generating an output like an action) in the different device.

The encoding of signals may be accomplished by embedded a tone in an audio or sound file such as a song. A decoder, which is programmed to identify the tone frequency of the song, can be used to filter out the embedded signal which is different than the tone frequency of the song. Alternatively, inaudible tones, either lower or higher than a human's hearing range, can be used with the audio signal. Some electronic devices have an audio range of typically 20-22 kHz at the higher end of the range and as low as 10 Hz at the lower end of the range. In another embodiment, the pulse width of the tones can be used to communicate a signal. The decoder or processor can count the pulse width of the tones. The sinusoidal wave audio file can be chopped or separated into pulses, the frequency of which can be analyzed and the embedded signal identified.

In other embodiments, the encoding or embedding of data or information can be accomplished using monotones, duotones, a sequence of monotones and/or duotones, dual-tone multi-frequency (DTMF) signaling, a mixture of particular tones (such as to form a code using a timed sequence of tones), a frequency change in the tones of a signal, multiple tones at the same time, audible tones, or inaudible tones.

The electronic device may have a record application programming interface (API) to process real time audio as it is coming in to the electronic device. The application functions as a decoder of the audio input as it is received. In one embodiment, the functioning of the electronic device can be changed by clicking on/off the microphone jack, which would allow the detection of the sound, such as a pop, to be used as a signal. Some functionality may be to advance to the next song, to turn the device on, etc. Also, for example, the microphone jack can detect a press and hold on the microphone line as opposed to a single press. Alternatively, by pressing and holding the line, the circuitry of the electronic device may be coupled to an AC/DC circuit.

As shown in FIG. 3, in an alternative embodiment, the housing 72 may include a port or jack 78 into which another plug can be inserted. Thus, the module 70 can be used to receive and process one or more signals from the device 50 and then audio signals can be heard by the user via headphones when they are coupled to the module 70.

Referring back to FIG. 1, the electronic device 20 may include a visual output component 24, such as a screen or display. In one mode of operation, the screen 24 can be used as an input for the electronic device 20. In another mode of operation, the screen 24 can be used as an output for the electronic device 20.

Figure 4:
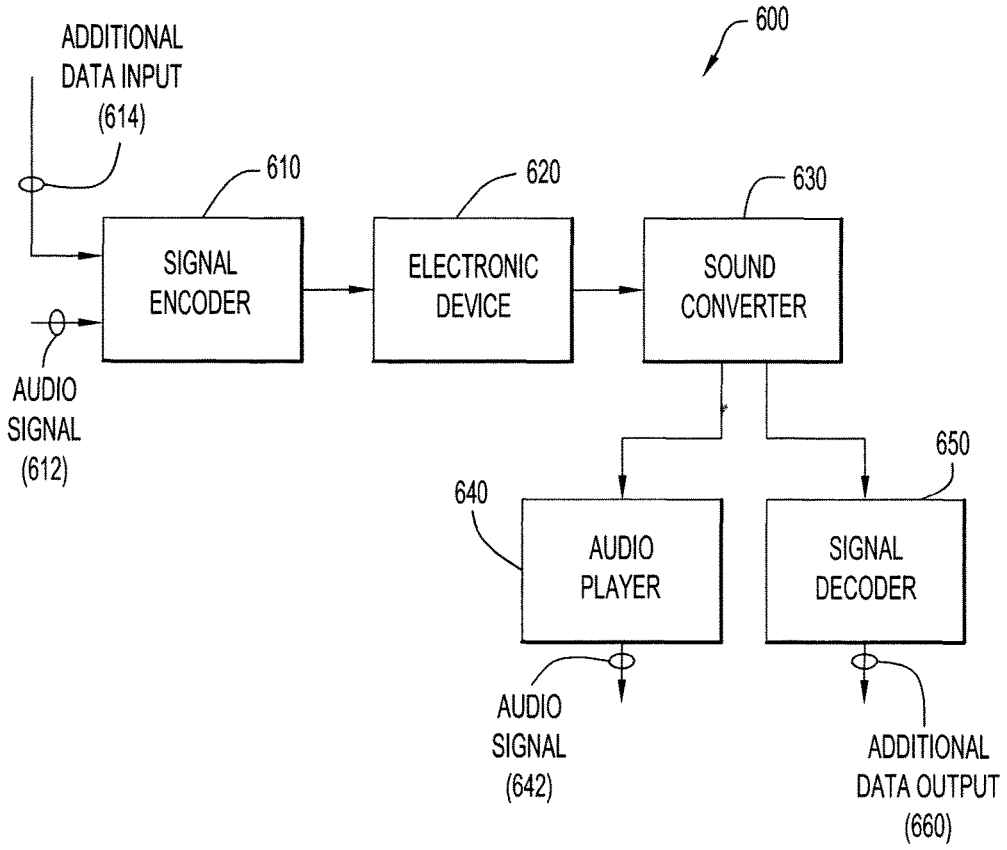
FIG. 4 illustrates a schematic block diagram of a system according to an embodiment of the invention.

Referring to FIG. 4, another system for processing information from an electronic device is illustrated. In this embodiment, the system 600 includes an electronic device 620 and a sound converter or decoder 630 that is operably connected to the electronic device 620. The system 600 also includes a signal encoder 610 that receives an audio signal 612 and an additional data input 614. The encoder 610 processes the received signal 612 and input 614 for the electronic device 620. The processing by encoder 610 involves embedding the information or data input 614 into the audio signal 612. The embedded information can be visible or invisible in the signal 612.

In one embodiment, the signal encoder 610 can be part of the electronic device 620. In another embodiment, the signal encoder 610 can be separate from the electronic device 620 and can be connected, either in a wired manner or a wireless manner, to the electronic device 620.

The system 600 includes a sound converter 630 that receives the signal output by the electronic device 620. The sound converter 630 is external to the electronic device 620. In one embodiment, the sound converter 630 can include a plug that is inserted into a 3.5 mm stereo headphone jack of the electronic device 620. As described below, in that embodiment, the sound converter 630 can transmit one or more signals to a separate electronic device. In another embodiment, the sound converter 630 is part of another electronic device.

The system 600 includes an audio player 640 that is separate from the electronic device 620. The audio player 640 receives the audio signal from the sound converter 630 and can reproduce an audio signal 642 for a listener to hear. A signal decoder 650 receives the data input 614 portion of the signal from the converter 630 and can decode the additional information from the data input 614. The decoded information is in the form of an additional data output 660 that can be used by an electronic device to perform one or more actions, movements, etc. For example, the additional data output 660 can be one of an infrared (IR) control, motor movement, a light trigger, a sound trigger, or the like.

In alternative embodiments, the electronic device 620 can be running an application other than an audio generating program. For example, in one embodiment, the signal 612 can be a video signal and the data input 614 is embedded in the video signal 612. In another embodiment, the signal 612 can be one or more picture files and the data input 614 is embedded in the picture files. The embedded information can be visible or invisible in the signals 612.

Similarly, electronic devices can generate outputs that include an embedded signal and a toy can "listen" for a particular electronic device by detecting and processing embedded information or data signals and then causing the toy to perform some action when the signal for which the toy is looking is identified. In these examples, either or both of an electronic device and a toy can emit watermarking signals that can be used to identify the particular item. In one implementation, a child can pretend to call a character, such as Barbie, on a phone with another character, such as Ken. When the phone and the toy figures, Barbie and Ken, have emitted encoded watermarking signals, the phone and the toys have confirmed that proper electronic devices (including the toy figures) have been identified, the child and the toy figures can pretend to have a three way conference call. In a different embodiment, speech recognition can be used to identify particular toy figures that are "speaking."

Similarly, in another embodiment, the software of a game can listen for a particular electronic device, such as a phone, and the phone can listen for a particular game. In another embodiment, the electronic device, such as an iPhone mobile digital device, could be running an application that continually searches for a particular toy or device. When the signal for which the electronic device is searching is identified, then the electronic device can join the new device as an additional player in a game or as an additional "caller" to an exiting "conference call."

Figure 5:
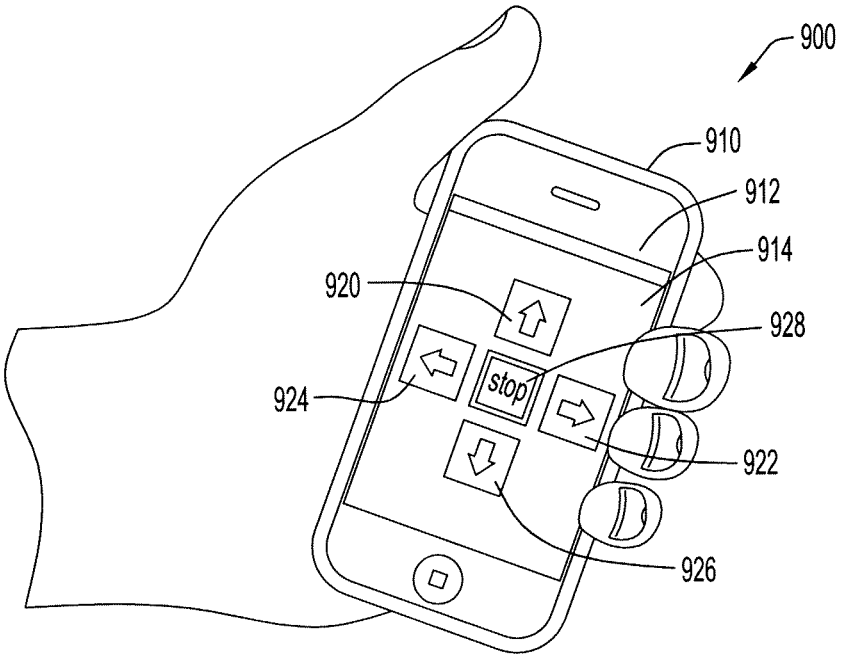
FIG. 5 illustrates a perspective view of an embodiment of an audio remote according to the present invention.
Figure 6:
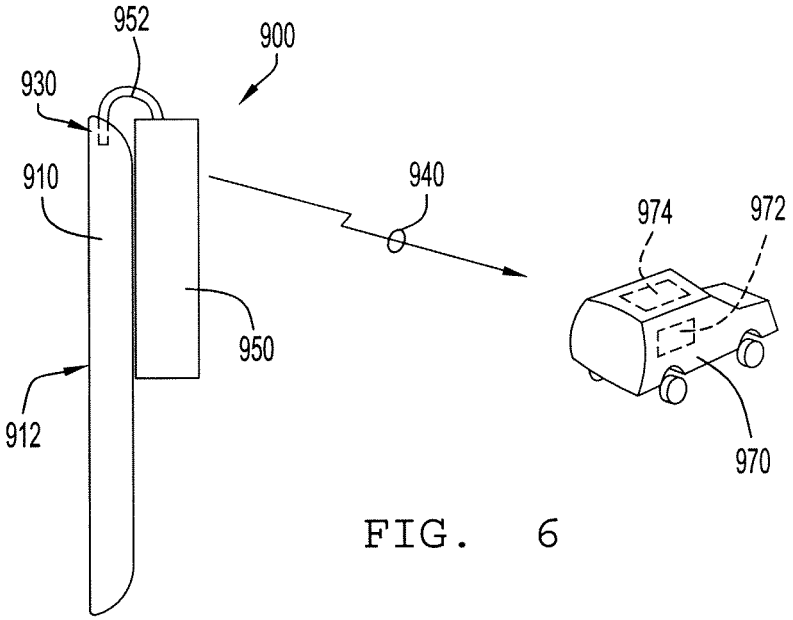
FIG. 6 illustrates a perspective view of the audio remote illustrated in FIG. 5 and a remote object.

Referring to FIGS. 5-6, an exemplary embodiment of an audio remote 900 that can be used as a remote control with an electronic device 910 is illustrated. In this embodiment, the electronic device 910 is a mobile device, such as an iPhone, iPod, or other audio player. The audio remote 900 includes an electronic component 950 that is coupled to the electronic device 910. The electronic component 950 is connected to an audio jack 930 of the device 910 via a wire 952. As described in detail below, the electronic component 950 is configured to transmit a signal 940 to a remote object 970. In this embodiment, the remote object 970 is a toy vehicle with a drive mechanism 972 and an IR receiver 974, such as a photodiode, that can receive an IR signal 940 from the audio remote 900. In other embodiments, the remote object 970 can be a character, a figure, a play set, or other device that can receive instructions to cause at least one movement of a portion of the remote object 970. Audio remote 900 may transmit the signal 940 via any of a wide variety of known wireless remote control techniques, including without limitation IR light, visible light, ultraviolet light, analog or digital radiofrequency signals, or RF signals according to various standards, such as 802.11 or Bluetooth. Remote object 970 would therefore include a corresponding receiver adapted to receive signal 940.

Referring to FIG. 5, the electronic device may include a touch screen or display 912 that present a user interface 914 that can be manipulated by a user to send control instructions from the audio remote 900 to the toy vehicle 970. The user interface 914 includes several graphic objects displayed on the screen 912. Graphic object 920 is a virtual button that is associated with movement of the remote object 970 in a forward direction. In addition, graphic object 920 may include indicia, such as an arrow pointing away from the user of the electronic device 910 and the word "Forward." Similarly, graphic objects 922, 924, and 926 are virtual buttons associated with movement of the toy vehicle 970 to the right, to the left, and reverse, respectively. Each of the graphic objects 922, 924, and 926 can include an arrow pointed in the proper direction as well as the associated word "Right," "Left," or "Reverse." The user interface 914 also includes a virtual button 928 that is associated with stopping the vehicle. This button 928 may have a different color, such as red, a stop sign configuration, and/or the word "Stop" thereon.

Each one of the Forward, Reverse, Right, Left, and Stop functions generates an audio tone, which is output from the audio jack 930 of the device 910 to the circuit of electronic component 950. The electronic component 950 converts the received audio signal into an IR control signal that can be transmitted to the toy vehicle 970 to control the movement thereof.

Referring to FIGS. 7-10, some of the components of the audio remote 900 and their usage are illustrated. As mentioned above, in the described embodiment the audio remote 900 is intended to be used as an IR remote adapter/converter for an electronic device 910. The control commands are recorded as audio files in any format that is playable by the player or device, such as .wav, .mp3, .m4a files or other audio file formats, or the control commands may consist of bursts of tones at particular frequencies and may therefore be generated on-the-fly by an application running on electronic device 910. As described below, the audio remote 900 modulates the incoming audio signal by an IR carrier frequency and sends the signal to one or more IR LEDs.

Figure 7:
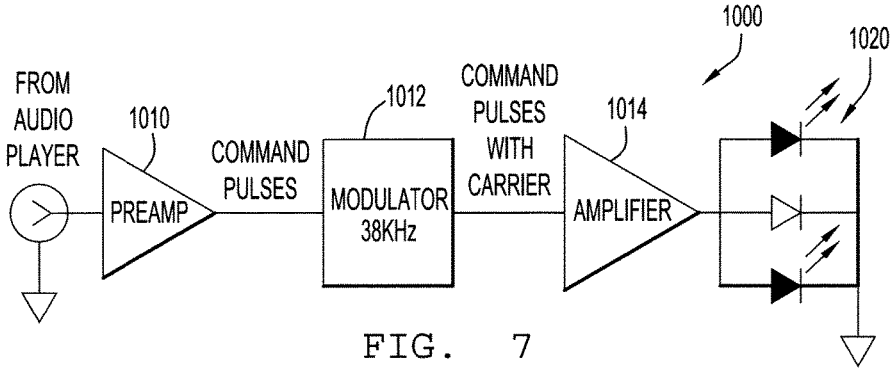
FIG. 7 illustrates a schematic block diagram of the structure of an audio remote according to an embodiment of the invention.
Figure 8:
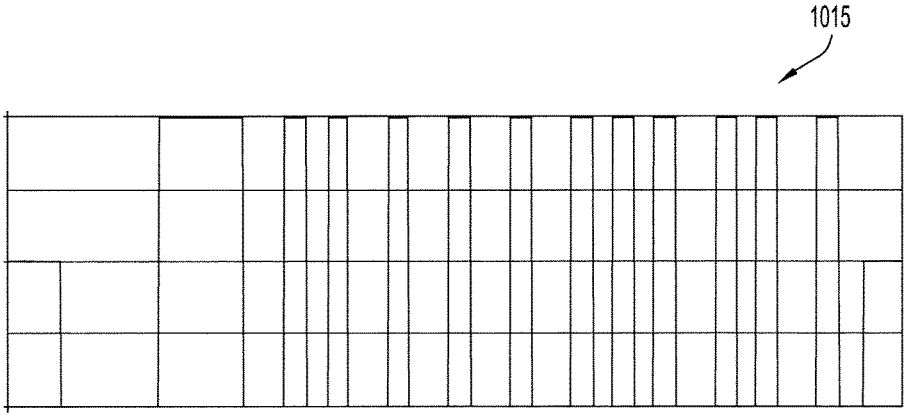
FIG. 8 illustrates an exemplary prerecorded audio command according to an embodiment of the invention.
Figure 9:
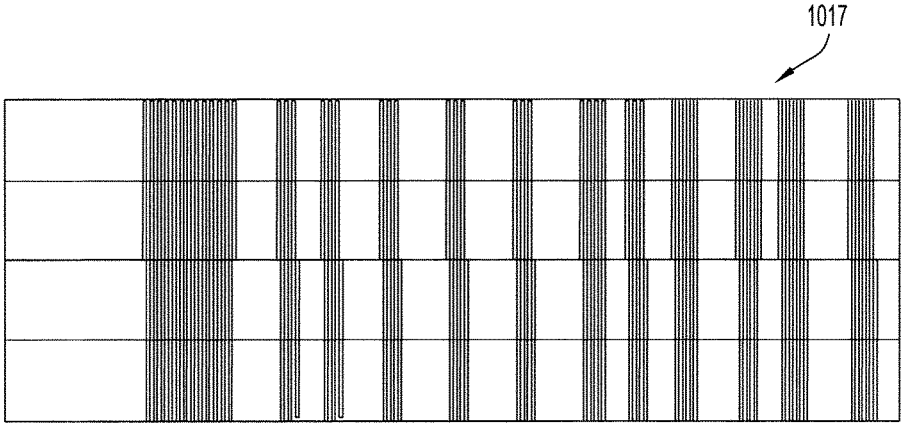
FIG. 9 illustrates the command illustrated in FIG. 8 after it has passed through the modulator of the audio remote illustrated in FIG. 7.

Referring to FIG. 7, some of the components of the circuit 1000 of audio remote 900 are illustrated. The audio remote 900 takes an audio signal such as audio tones from an audio player and passes it through a preamplifier 1010 which amplifies the signal to command pulses as shown in FIG. 8. The command pulses pass through a modulator 1012 which combines the command signal with a 38 kHz carrier signal, resulting in a command signal as illustrated in FIG. 9. In other embodiments, a signal with a different carrier frequency may be used, such as a 2.4 GHz or 5 GHz carrier signal.

Figure 10:
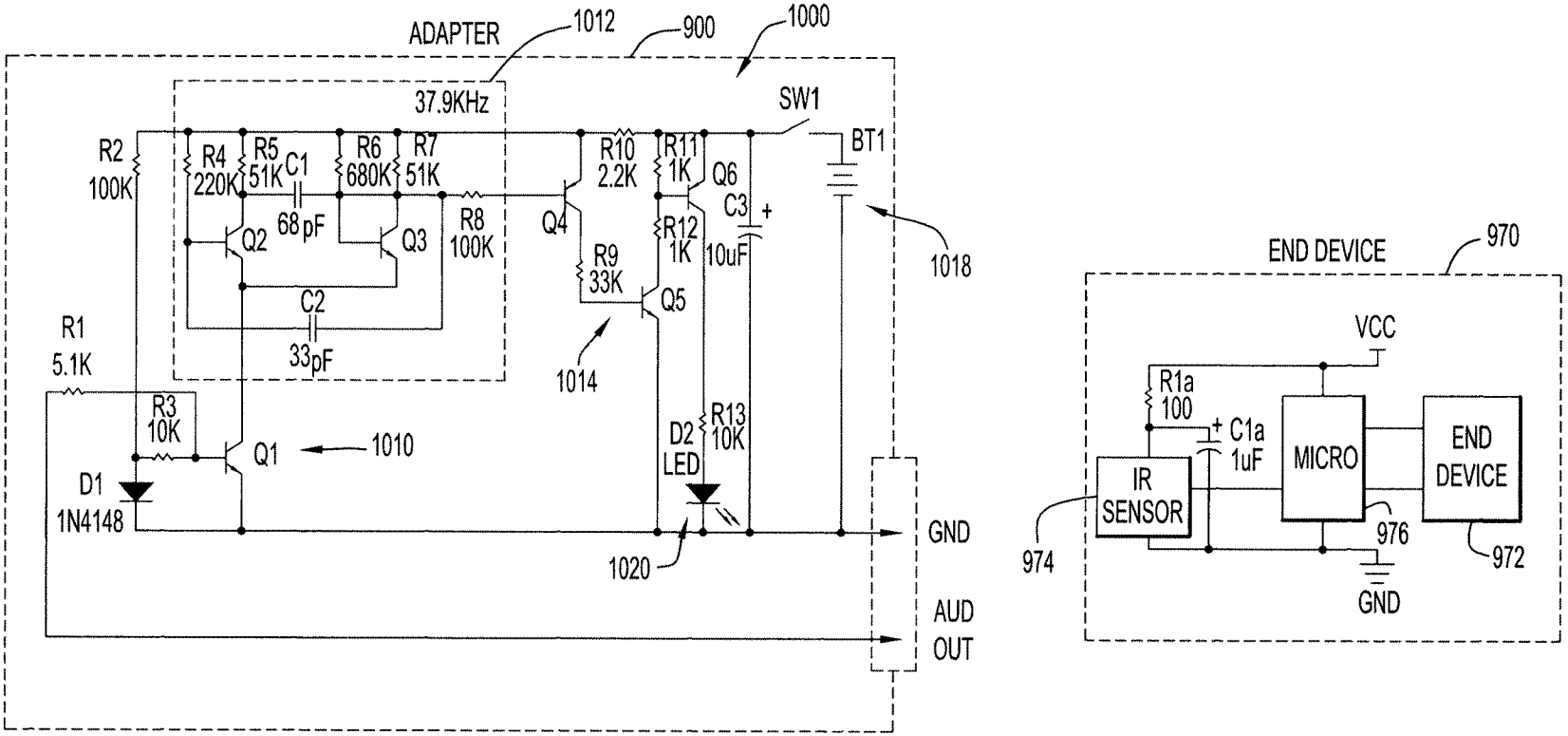
FIG. 10 illustrates a schematic diagram for an adapter and an end device according to an embodiment of the invention.

An exemplary electrical schematic diagram of the audio remote 900 is illustrated in FIG. 10. As mentioned above, and as shown in FIG. 10, the adapter 900 includes a preamplifier circuit 1010 for the audio signal, a modulator circuit 1012 that combines the audio command signal with a 38 kHz carrier signal, and an amplifier 1014 to amplify the combined signal for output by IR LED 1020. The modulated signal next passes through amplifier circuit 1014 to at least one output LED 1020, though multiple LEDs may be provided to enhance signal transmission and reception. The LED 1020 transmits the IR command signal from the audio remote 900 to the remote object 970. The circuit 1000 also includes its own power supply, illustratively shown as battery BT1, 1018.

The output command signals of the IR LED 1020 are detectable by the IR receiver 974 of the remote object or end device 970. The remote object 970 includes a microprocessor 976 that provides the resulting instructions from the received commands to one or more end devices 972, which can include one or more drive mechanisms in the remote object 970. For example, the remote object 970, such as a toy vehicle, may have two drive mechanisms in a "tank steering" configuration. In one implementation, the instructions can be to activate a motor or drive mechanism to cause one or more wheels or to be driven to move the toy vehicle forward or backward or to turn the toy vehicle in a different direction by operating wheels on different sides of the vehicle at different rates or in opposing directions.

In different embodiments, the user interface may include graphic objects and functionalities in addition to the driving functions described above. For example, a toy vehicle may have one or more movable parts, such as a turret, a crane, an arm, or other movable structure that can be moved by a drive mechanism on the toy vehicle. The parts can be moved in any number of directions relative to the body of the toy vehicle.

Figure 11:
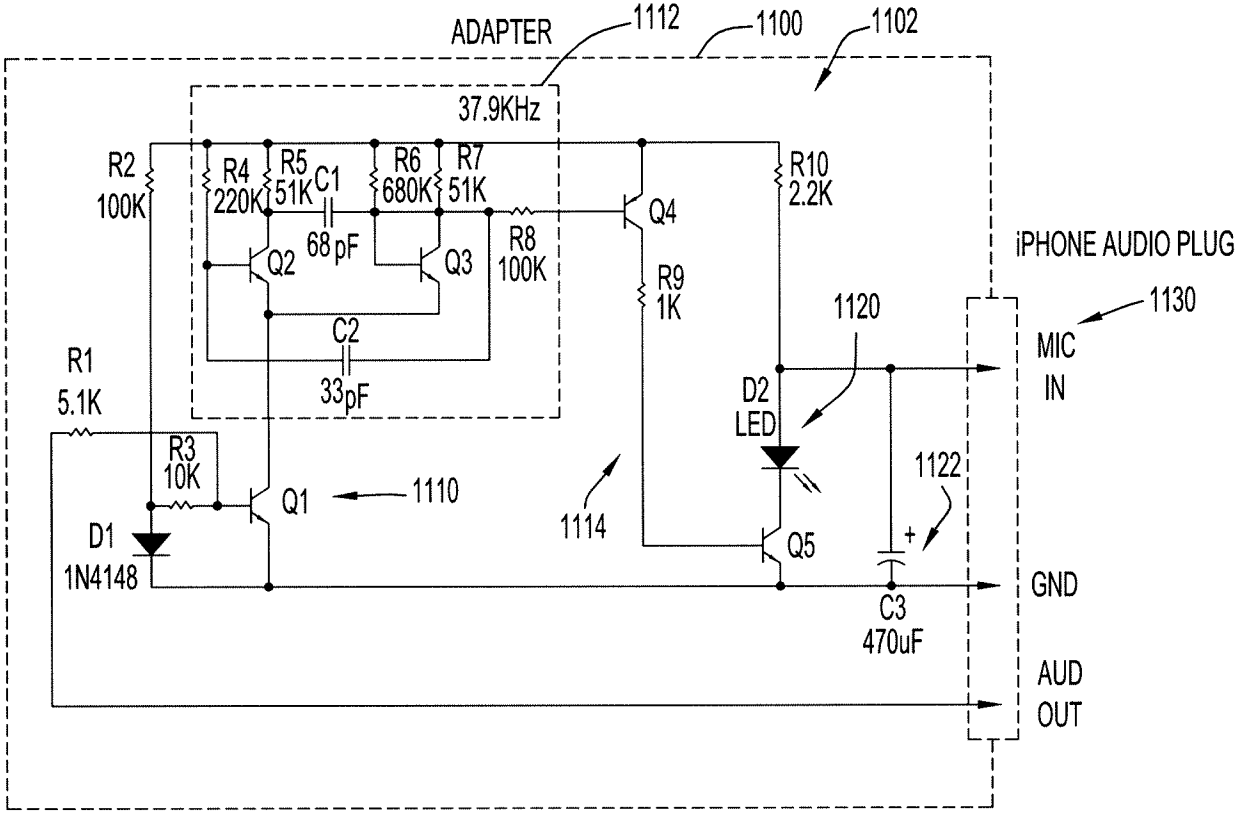
FIG. 11 illustrates a schematic diagram for an adapter according to an embodiment of the invention.
Figure 12:
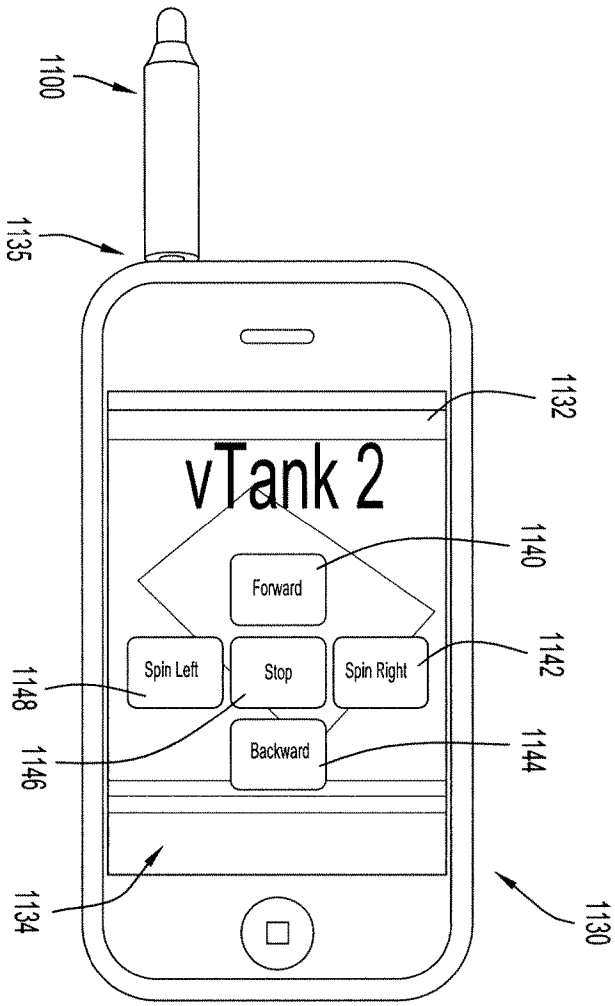
FIG. 12 illustrates a plan view of an audio remote according to an embodiment of the invention.

Referring to FIGS. 11 and 12, another embodiment of an audio remote is illustrated. In this embodiment, the audio remote 1100 is an adapter with many components similar to those discussed above for audio remote 900. Some audio players provide the possibility to use the internal power supply of the audio player to power external devices. For example, some audio players provide audio and microphone connectors (or a combined audio/microphone jack), including three leads (audio out, microphone, and ground/common). In such players, the microphone lead provides a bias voltage that can be used as a source of power for an external device, though the voltage and/or current levels from such a power source are often quite limited. Audio remote 1100 can be used with such an audio player, particularly, because the audio remote 1100 does not have its own power supply.

As shown in FIG. 11, the circuit 1102 of the audio remote 1100 includes a preamplifier circuit 1110, a 38 kHz modulator circuit 1112, and an amplifier circuit 1114 for the output LED 1120. The microphone bias input provided by the microphone jack 1135 of the electronic device 1130 is used to power the audio remote 1100, which is coupled as a dongle to the device 1130. Because microphone bias current is quite limited, capacitor 1122 is provided to store charge from the microphone bias during the time between command pulses discharged through the LED during the transmission of IR command pulses from the audio remote 1100.

Referring to FIG. 12, the electronic device 1130 may include a touch screen or display 1132 on which a user interface 1134 can be provided. Similar to the user interface 914 illustrated in FIG. 5, user interface 1134 includes several graphic objects configured to resemble buttons. Graphic objects or virtual buttons 1140, 1142, 1144, and 1148 are associated with forward, spinning to the right, reverse, and spinning to the left movements, respectively, of a remote toy vehicle, such as a tank. The user interface 1134 also includes a stop object or button 1146 that can be actuated to stop movement of the toy vehicle. When the touch screen 1132 of the electronic device 1130 senses a touch of a user in the area of one of the graphic objects 1140, 1142, 1144, 1146, and 1148, the application determines the selection of the particular function associated with the selected graphic object. Each function generates an audio tone, which is then output by the audio jack 1135 of the device 1130 to audio remote 1100. The audio remote 1100 converts the received audio tone signal into an IR control signal that can be received by the toy vehicle 970 to control the movement thereof.

Figure 13:
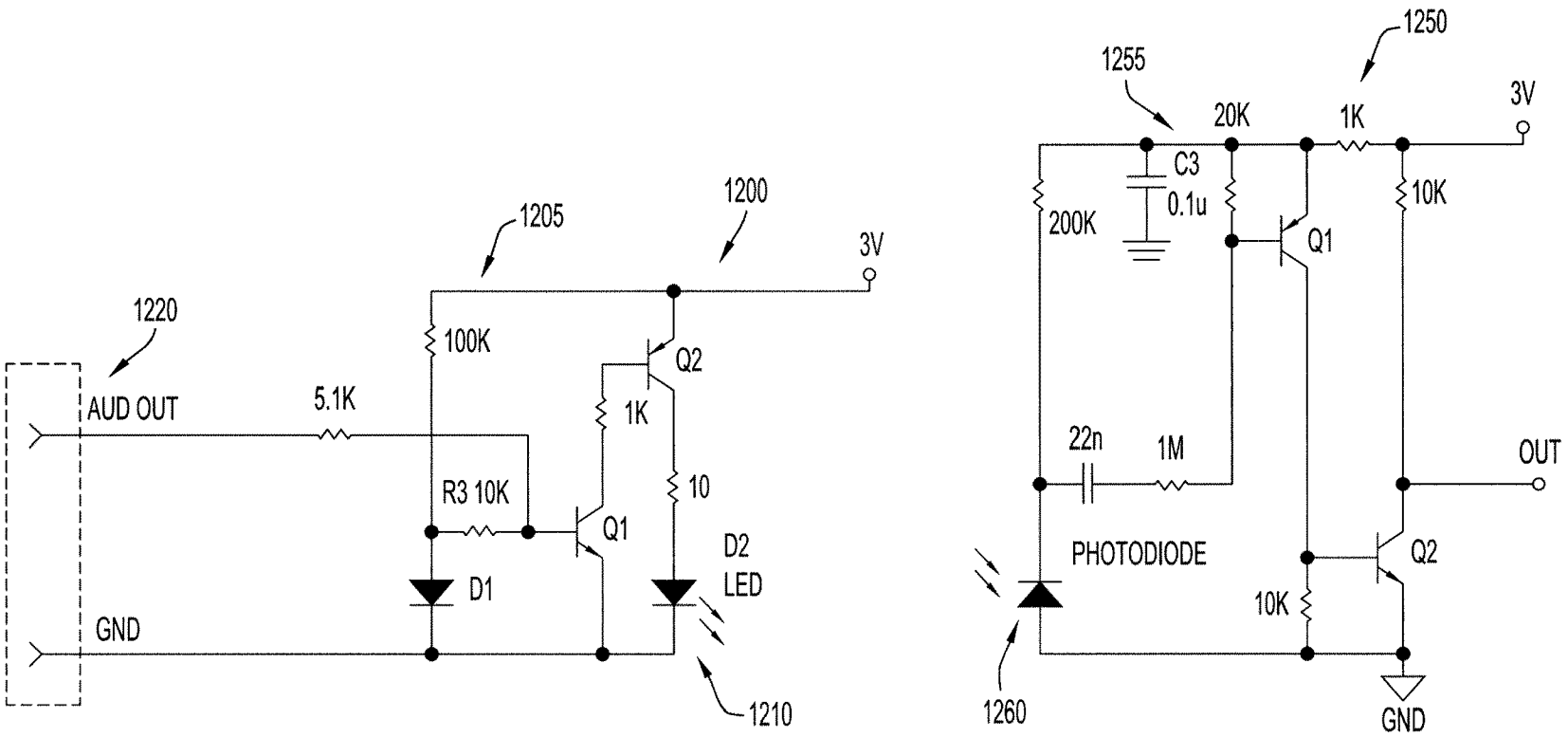
FIG. 13 illustrates a schematic diagram for a system according to an embodiment of the invention.

Referring to FIG. 13, a schematic diagram of another embodiment of an audio remote is illustrated. In this embodiment, any type of information, such as commands, can be transmitted on the baseband signal without a carrier signal. In this implementation, the IR receiver decodes the unmodulated IR signal at baseband frequencies. The transmission of the signal can provide a data rate of up to 9600 baud or higher, based upon the audio output components included in the electronic device 1130.

In this embodiment, the audio remote 1200 includes a circuit 1205 that receives an audio signal 1220 and generates an output of an IR transmission signal via an output LED 1210. The IR signal is not merged with a carrier signal. A remote object 1250 has its own circuit 1255 with a photodiode 1260 configured to receive the transmitted IR signal from the LED 1210 at baseband frequencies. The remote object 1250 can be controlled by the audio remote 1200 in this arrangement as well.

In an alternative embodiment, in a stereo system, one channel could be used for command transmission and the other channel could be used for an audible signal, such as music and/or speech. That arrangement can be used for controlling an animated toy object with the possibility to change or pre-record different animation sequences and sounds.

The communications between electronic devices described above can be accomplished between different types of electronic devices. In other words, one type of electronic device can communicate with a different type of electronic device.

In different embodiments, the types of devices that can be used to receive signals from an electronic device can include, but are not limited to, vehicles such as tanks, cars, flying craft, or water craft, and other toys such as toy figures, game boards or sets, and action figures. The movement of the toys can be controlled by the signal from the electronic device. In one example, an electronic device, such as a phone, can be used as a controller and send a signal to a toy figure or doll. The electronic device and the toy figure can have simulated conversations with the electronic device functioning as a phone. Alternatively, the toy figure may have one or more mechanical movements that are activated by signals from the electronic device.

As an alternative to external devices that can be controlled, the signals can be used to control accessories that are attached to an electronic device, such as a hybrid phone and device system. In addition, the signals can be used to control game states on a network.

In different embodiments, the external device or object may include any one of the following indicators that can include, but are not limited, an LED-illuminated device that changes color or intensity, a bobble-head doll that vibrates, a motorized element that moves to a different position, a push-puppet that sags or straightens up, a screen (such as an LCD, e-paper, etc.) that changes an image or text, an audio enunciator device that announces, an analog meter that changes position.

In some embodiments, a signal coming in from the headphone jack can be converted to an IR signal. In other embodiments, a signal coming in from the headphone jack can be converted to an RF signal. In other embodiments, a signal coming in from a dongle or wireless adapter, can be sent to an electronic device.

Figure 14:
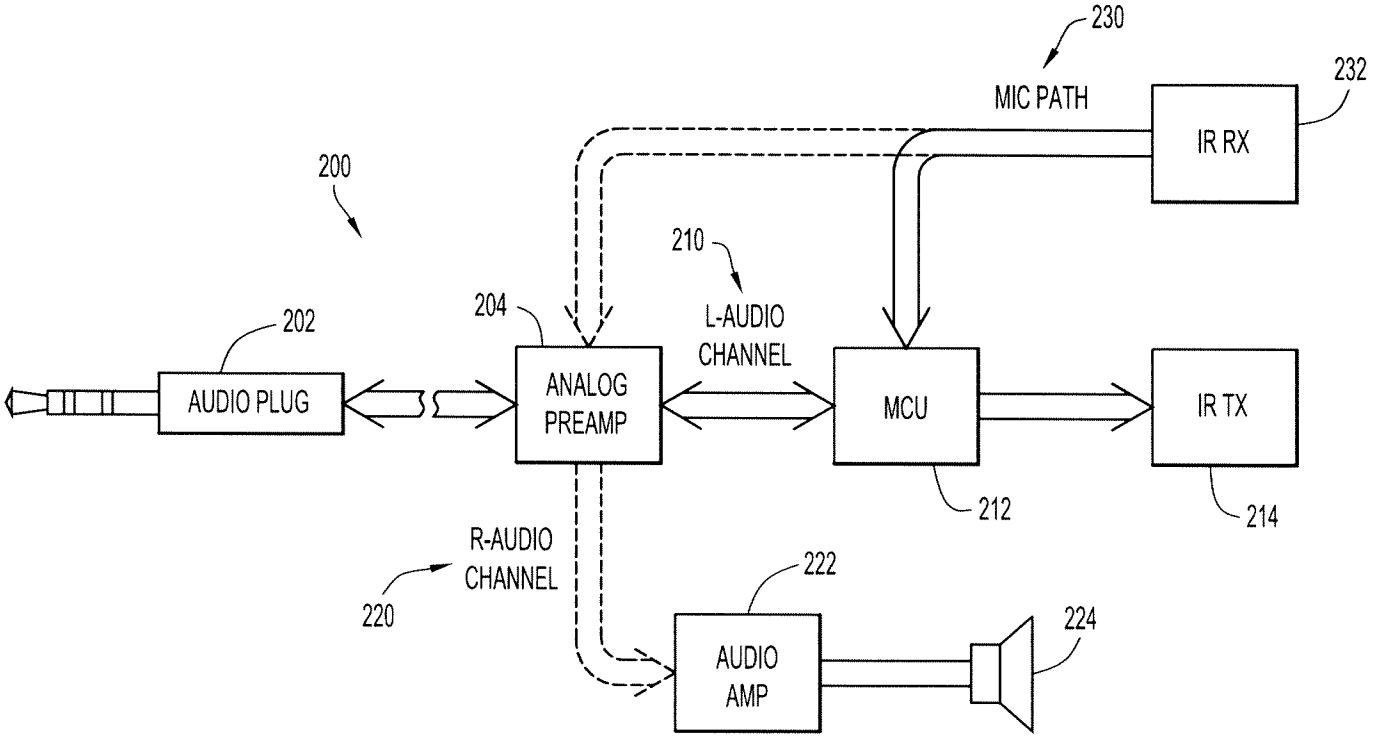
FIG. 14 illustrates a schematic diagram for a system according to an embodiment of the invention.
Figure 15:
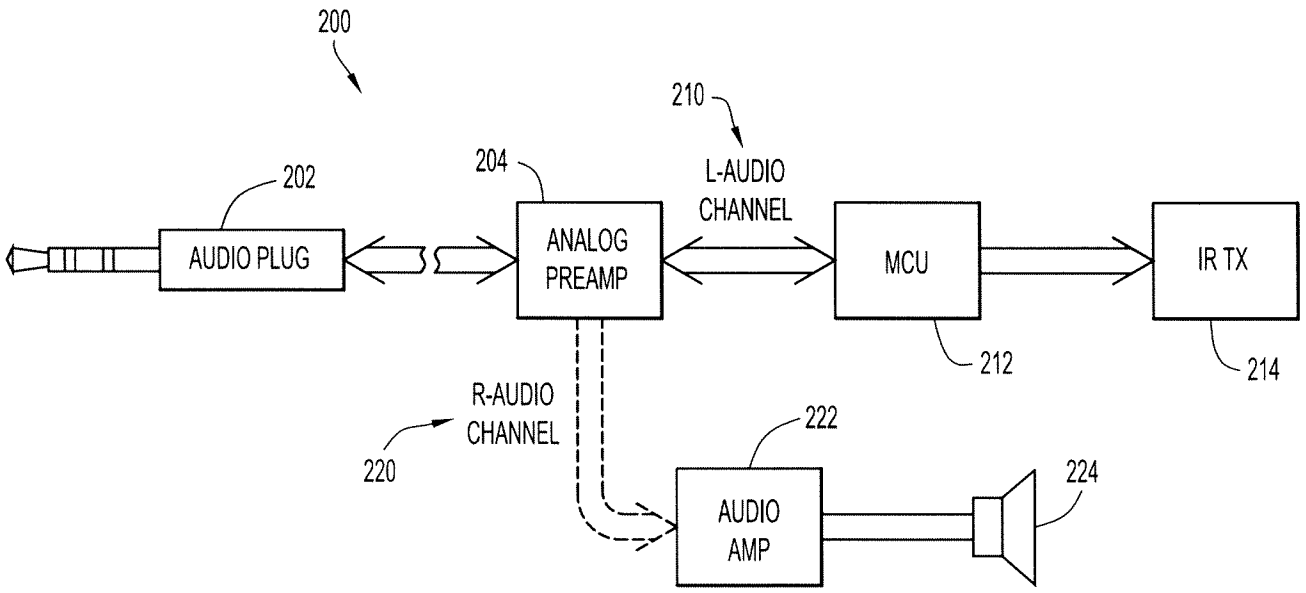
FIG. 15 illustrates a schematic diagram for a system according to an embodiment of the invention.

Referring to FIGS. 14 and 15, schematic diagrams of an IR dongle with a speaker are illustrated. The embodiment of an IR dongle illustrated in FIG. 14 includes the components of the IR dongle illustrated in FIG. 15 with an additional IR receiver, as discussed below. As described in previous embodiments, the IR dongle 200 consists of a plug 202 connected to circuitry which includes an analog preamplifier 204 and two audio channels, a left audio channel 210, and a right audio channel 220. The plug 202 of the IR dongle 200 connects to a headphone jack of an electronic device. The electronic device is programmed to send burst data via an audio signal containing two audio channels (a first data signal and a second data signal) to the headphone jack. The plug 202 keeps the two data signals separate from each other. The preamplifier 204 inside the dongle 200 processes the burst data, directing the first data signal along the left audio channel 210 and the second data signal along the right audio channel 220, or vice versa. The data signal in the right audio channel 220 is a mono sound audio signal, where the signal is processed by an audio amplifier 222 and then output via a speaker 224 in the dongle 200. The signal in the left audio channel 210 is processed by a control unit or microcontroller 212, which is then converted to an IR command signal, that is then sent to the transmitter 214 to be transmitted to the RC vehicle (as shown in FIG. 6).

Furthermore, according to the schematic diagram in FIG. 14, the dongle 200 contains a microphone path 230. The microphone path 230 is a signal input into the dongle 200, and ultimately the electronic device. The microphone path 230 contains an IR receiver 232, which is capable of receiving an IR signal from a remote object. As illustrated, the microphone path 230 can be connected into the control unit 212 of the left audio channel 210 or the preamplifier 204. Depending on the pathway of the microphone path 230, the control unit 212 or the preamplifier 204 would decode the incoming IR signal to a data signal and send it to the electronic device via the audio plug 202 and electronic device headphone jack. The received IR signals are decoded by the application on the electronic device and some unique digital assets are generated. In one embodiment, the digital assets are visual and are generated on the screen of the electronic device. This data input may be used as part of a game or interaction between augmented reality and physical objects under control of the electronic device as well.

Figure 16:
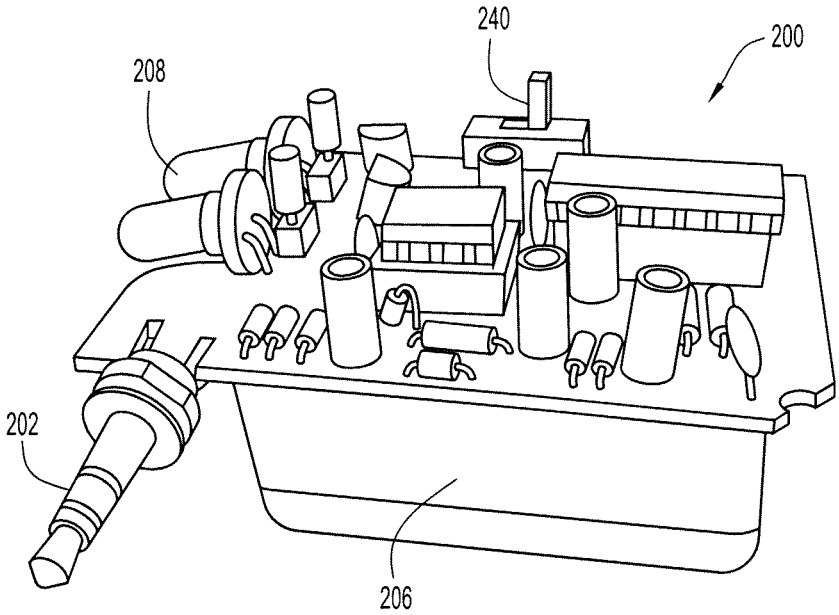
FIG. 16 illustrates a perspective view of the audio dongle of the present invention.
Figure 17:
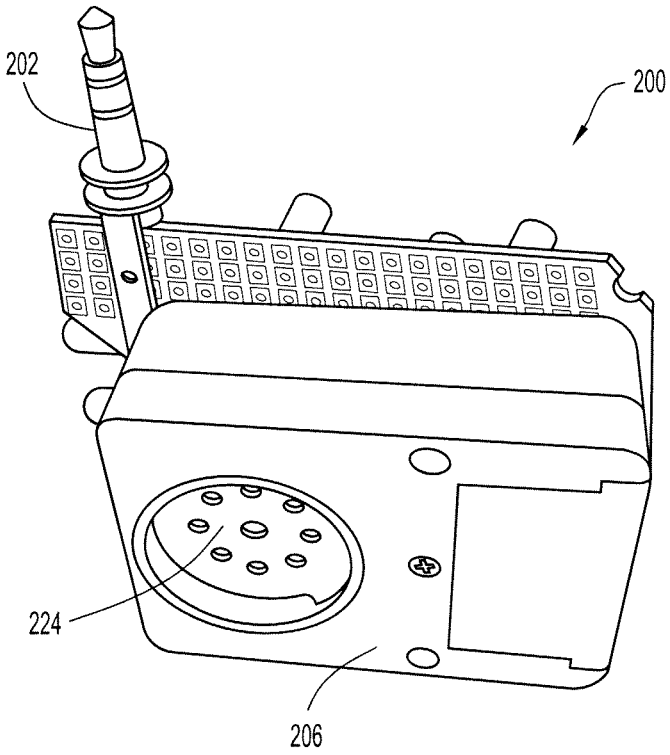
FIG. 17 illustrates a bottom view of the audio of the present invention.

Referring to FIGS. 16 and 17, illustrated is an embodiment of an IR dongle represented by the schematic diagram of FIG. 15. In this embodiment, the dongle 200 includes a plug 202 and a switch 240. As illustrated, the plug 202 is a standard 35 mm headphone plug, designed to fit within the headphone jack of an electronic device. The switch 240 is able to turn the dongle 200 on and off, thus turning on and off the transmission of the IR signal from the electronic device. Furthermore, the dongle 200 contains LEDs 208 that function as IR signal transmitters to send a signal externally from the dongle. In various embodiments, one of the LEDs can be used to indicate whether or not the dongle 200 is turned on, whether or not the dongle 200 is sending an IR signal, and/or whether or not the dongle 200 is receiving an IR signal. Furthermore, on the bottom of the dongle 200 is a casing 206 which contains the speaker 224 that outputs the sound from the electronic device.

As set forth above, there are several ways to provide input to an operating system of an electronic device. One method of input is to simulate touch events to transfer data into the operating system. A series of touch events can be mechanically or electrically generated at a single point. Alternatively, a pattern of touch events (either multiple simultaneous) can be mechanically or electrically generated at different locations on a touch screen.

As set forth above, the different types of output from an electronic device can vary. In one embodiment, an audio output may contain watermarking to communicate to other devices, such as toys, and to children simultaneously. In another embodiment, an audio output may contain data tones to communicate directly to toys. In another embodiment, a customized accessory or module can be used with an audio jack output for remote control of a separate device and/or for control of a device which is part of the system including the originating electronic device and another device. In another embodiment, the output may be a WiFi signal to another device or to a router or hub. In another embodiment, the output may be a Bluetooth signal to another device or a custom accessory. In another embodiment, the output may be via a cellular network which relays data from toys to the Internet. In another embodiment, the output may be a screen blinking data pattern, such as in one portion of the screen, which is used to communicate with a toy. In another embodiment, the output can be vibration which can be a direct feedback to a user and/or a communication to an external device.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Therefore, although the disclosed inventions are illustrated and described herein as embodied in one or more specific examples, it is nevertheless not intended to be limited to the details shown, since various modifications and structural changes may be made therein without departing from the scope of the inventions. Further, various features from one of the embodiments may be incorporated into another of the embodiments. Accordingly, it is appropriate that the invention be construed broadly and in a manner consistent with the scope of the disclosure.

What is claimed is:

1. A module that connects to an electronic device, enabling the electronic device to control a toy vehicle, comprising:

an input connector capable of connecting the module to an electronic device and configured for receiving signals from the electronic device;

a control unit connected to the input connector, the control unit processes a signal received from the input connector;

an infrared emitter connected to the control unit; and an output device connected to the control unit and configured to generate audible outputs;

wherein the control unit sends an emitter control signal to the infrared emitter.

2. The module of claim 1, further comprising a microphone input path connected to the control unit.

3. The module of claim 2, further comprising an infrared receiver for receiving infrared signals to be processed by the control unit.

4. The module of claim 1, wherein the infrared emitter is a light-emitting diode.

5. The module of claim 1, further comprising a casing, wherein the casing houses the control unit and is removably coupleable to the electronic device via a jack.

6. The module of claim 1, wherein the output device is a speaker.

7. A module that connects to an electronic device, enabling the electronic device to control a toy vehicle, comprising:

a control unit;

an input connector connected to the control unit and capable of connecting to an electronic device, the input connector configured for receiving signals from and transmitting signals to the electronic device;

an infrared receiver that receives infrared signals to be processed by the electronic device, the infrared receiver connected to the control unit via a microphone input path;

an infrared emitter connected to the control unit; and an output device connected to the control unit and configured to output audible outputs;

wherein the control unit processes signals sent from the electronic device into an emitter control signal and sends the emitter control signal to the infrared emitter.

8. The module of claim 7, wherein the infrared emitter includes a light-emitting diode configured to transmit infrared signals from the module.

9. The module of claim 7, wherein the module further comprises a casing, wherein the casing houses the control unit and the microphone input path.

10. The module of claim 7, further comprising a switch configured to turn the module on and off.

11. The module of claim 7, wherein the input connector is configured to be inserted into a headphone jack of the electronic device when the module is connected to the electronic device.

12. The module of claim 7, wherein the infrared receiver is configured to receive infrared signals sent from the toy vehicle.

* * * * *